US006351864B1

(12) United States Patent
Karafa et al.

(10) Patent No.: US 6,351,864 B1
(45) Date of Patent: Mar. 5, 2002

(54) INSTITUTIONAL BEDDING WITH INTEGRAL PILLOW AND MATTRESS

(76) Inventors: David M. Karafa, 14210 Worthington Dr., Granger, IN (US) 46530; Timothy W. Shelby, 11590 Austin Ct., Osceola, IN (US) 46561

( * ) Notice: Subject to any disclaimer, the term of this patent is extended or adjusted under 35 U.S.C. 154(b) by 0 days.

(21) Appl. No.: 09/340,288

(22) Filed: Jun. 28, 1999

(51) Int. Cl.[7] ..... A47C 27/14

(52) U.S. Cl. ..... 5/733; 5/724; 5/709; 5/699; 5/419

(58) Field of Search ..... 5/419, 420, 690, 5/699, 709, 724, 731, 733, 900.5, 413 R, 727, 656

(56) References Cited

U.S. PATENT DOCUMENTS

| | | | | | |
|---|---|---|---|---|---|
| 389,420 | A | * | 9/1888 | Sutton | 5/724 |
| 555,367 | A | * | 2/1896 | Fraser | 5/724 |
| 2,953,793 | A | * | 9/1960 | Rossi | 5/733 X |
| 3,268,922 | A | * | 8/1966 | Moxley | 5/420 |
| 3,372,407 | A | * | 3/1968 | Weber, III | 5/724 |
| 4,006,503 | A | * | 2/1977 | Wood | 5/656 X |
| 4,450,193 | A | * | 5/1984 | Staebler | 5/420 X |
| 5,117,517 | A | * | 6/1992 | Su | 5/699 X |
| 5,720,057 | A | * | 2/1998 | Duncan | 5/699 X |
| 6,038,722 | A | * | 3/2000 | Giori et al. | 5/731 X |

* cited by examiner

*Primary Examiner*—Michael F. Trettel
(74) *Attorney, Agent, or Firm*—Ryan Fountain

(57) ABSTRACT

A bedding arrangement is provided having a compressible foam mattress pad and compressible foam pillow pad integrated as a single bedding unit within a fluid resistant or impermeable cover whose seams are heat sealed together. Air ventilation through the cover and about the interior foam is permitted by a vent that restricts insect, article and fluid passage through the vent. By using foam of different densities and/or composition, optimum performance characteristics in terms of comfort and support can be obtained separately for the mattress portion and the pillow portion. By mounting two pillow pads within the cover, the bedding arrangement can be made reversible.

6 Claims, 1 Drawing Sheet

INSTITUTIONAL BEDDING WITH INTEGRAL PILLOW AND MATTRESS

BACKGROUND AND SUMMARY OF THE INVENTION

The present invention relates to bedding used in correctional institutions, hospitals and the like, and, more particularly, to foam filled, plastic covered bedding for use as mattresses and pillows.

Various governmental and private institutions, such as jails, prisons, and hospitals, need to provide bedding to large numbers of persons simultaneously. This bedding typically must include a mattress and a pillow in order to provide proper support for the human body and head during rest. Previously, a wide variety of materials and assemblies have been used for this purpose, typically involving a fabric covering for the mattress and a fabric pillow case. The mattress and pillow have been formed from a variety of materials, but also typically involving a fabric covering sewn together at its seams.

Such arrangements have been satisfactory for many purposes, but do have certain disadvantages. When it is necessary to routinely clean and sanitize the bedding, the mattress cover and pillow case must be removed, separately washed, dried and then separately reinstalled. Since this process may take some time, days even in large institutions, additional mattress covers and pillow cases are typically installed during the interim, and the former items are cyclically placed into storage/inventory until the next cleaning. Since the fabrics used are often porous, if a fluid is spilled onto or applied to the mattress cover or pillow case, the fluid may penetrate to the underlying mattress or pillow, and that item may additionally need to be cleaned, sanitized (if possible) or replaced entirely, often at relatively high cost. Thus, the cyclical cleaning process can be labor intensive, slow and expensive, requiring a relatively high volume of components and stored inventory.

Also, some prior bedding materials have been particularly susceptible to interior contamination from insects, fluid (blood, water, oil and the like) borne bacteria and virus and/or destructive fluids. Various methods of reducing that risk have been suggested, but often involving expensive and/or elaborate material, construction arrangements and ventilation methods.

Further, since over time and continual use bedding does tend to wear out or become irreparably contaminated or destroyed, many institutions must keep a replacement supply of bedding and bedding coverings in inventory as well. Unfortunately, many prior bedding arrangements are relatively expensive and thick, requiring considerable storage space for this inventory, and bulky, being more difficult to handle.

Moreover, bedding used in correctional institutions is faced with additional, special difficulties. Previously, some inmates have modified pillows and similar severable bedding elements into hard, blunt weapons capable of killing and/or as shields and like accessories to violent action. Also, bedding seams have been opened by severing the threads which hold the fabric together in order to hide contraband inside the bedding. The seams can then be lightly closed by tape and other means to render the contraband easily accessible to the inmate, but not easily or quickly detectable by guards and facility inspectors. In addition, the bedding material itself and/or coverings for that bedding, such as seam thread and padding, has been removed by the inmates to make contraband items or weapons.

It has also been found that some inmates tend to abuse the bedding to a much greater degree than other users normally would, thereby significantly decreasing its usable life. For example, penetration of the bedding by the inmate's bodily fluids inadvertently or otherwise can cause unsanitary conditions and destructive rot to exist inside of the bedding, as well as increase the required instances of cleaning for the bedding exterior. Nonetheless, when such bedding is removed for security or disciplinary reasons or deteriorates to an unserviceable state, even allegedly at the inmate's own hand, the denial of proper bedding has been the source of expensive and time consuming litigation against the correctional facility by the inmate, regardless of the outcome of the litigation.

In other applications, articles have been suggested which employ an integrated mattress and pillow, particularly for recreational use on or about water, which are formed of compressible foam or a heat sealed bladder. In the former structures, however, air ventilation within the article and about the foam with fluid restriction at the same time has been lacking. In the latter structures, incidental punctures have rendered the article unusable.

Accordingly, it is an object of the present invention to provide an improved bedding arrangement. Other objects include the provision of a bedding arrangement that is:

a. durable and relatively inexpensive to manufacture and maintain;
b. convenient to clean, sanitize and inventory;
c. less susceptible to misuse and abuse;
d. comfortable and properly supportive of the user during rest; and
e. more resistant to contamination.

These and other objects of the present invention are attained by the provision of a bedding arrangement having a compressible foam mattress pad and compressible foam pillow pad integrated as a single bedding unit within a fluid resistant or impermeable cover whose seams are heat sealed together. Air ventilation through the cover and about the interior foam is permitted by a vent that restricts insect, article and fluid passage through the vent. By using foam of different densities and/or composition, optimum performance characteristics in terms of comfort and support can be obtained separately for the mattress portion and the pillow portion. By mounting two pillow pads within the cover, the bedding arrangement can be made reversible.

Other objects, advantages and novel features of the present invention will now be readily apparent to those of ordinary skill in the art from the following drawings and description of preferred embodiments.

DETAILED DESCRIPTION OF PREFERRED EMBODIMENTS

Figure 1:
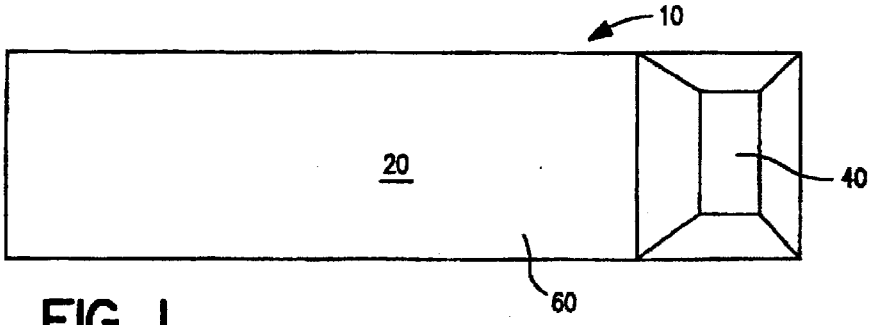
FIG. 1 shows a top plan view of a bedding arrangement according to the present invention.
Figure 2:
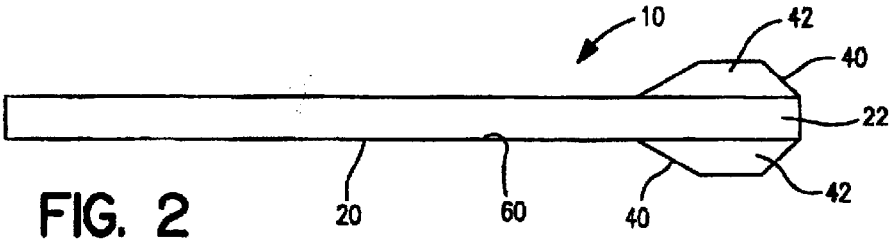
FIG. 2 shows a side view of the bedding arrangement of FIG. 1.
Figure 3:
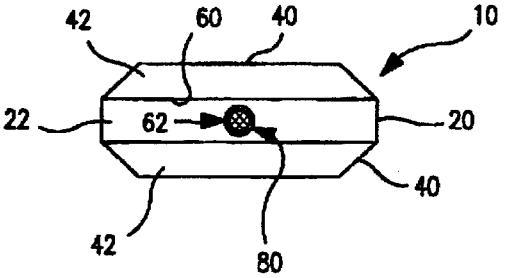
FIG. 3 shows a pillow end view of the bedding arrangement of FIG. 1.
Figure 4:
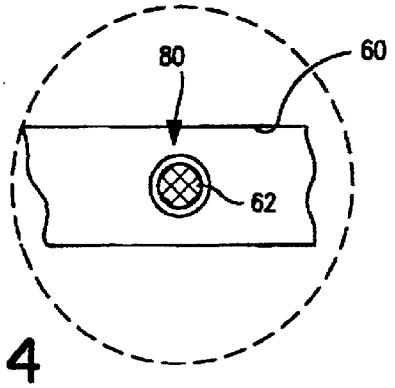
FIG. 4 shows an enlarged view of the vent portion of the bedding arrangement of FIG. 1.
Figure 5:
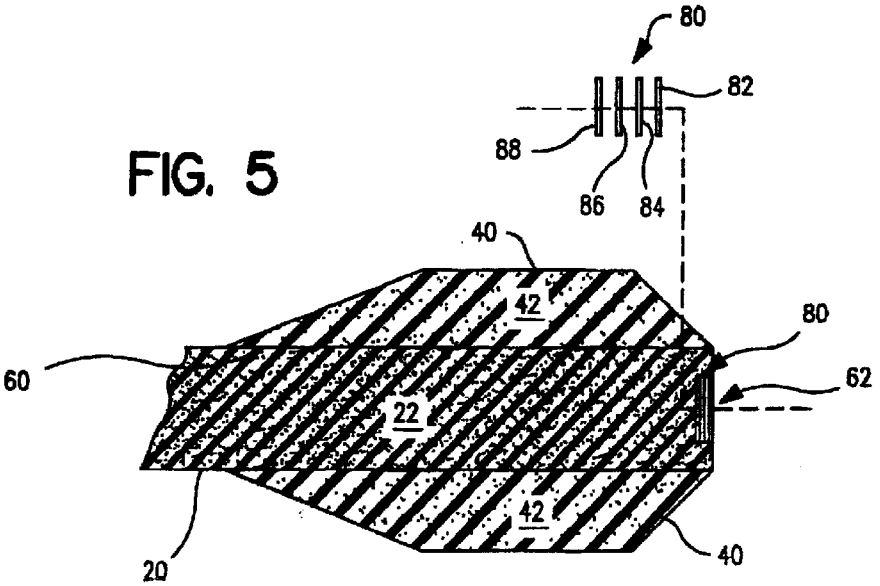
FIG. 5 shows an enlarged, cross sectional side view of a portion of the bedding arrangement of FIG. 1 with the vent components shown additionally exploded for ease of viewing, the enlargement not being exactly to scale of the enlargement of FIG. 4.

FIG. 1 shows a preferred embodiment of a bedding arrangement 10 according to the teachings of the present invention. Bedding arrangement 10 includes a mattress portion 20 and a pillow portion 40. Mattress portion 20 is formed from padding material 22 and sized into a body supporting dimension. Pillow portion 40 is formed from padding material 42 and sized into a head supporting portion. In the embodiment shown in the drawings, two pillow portions 40 are included on either side of one end of mattress portions 20. Preferably, these pillow portions are in fixed positions, with the end of mattress portion 20 sandwiched therebetween. However, it will be understood that if desirable in a given application, only a single pillow portion 40 may be used. An advantage of using two such pillow portions as shown is that it permits bedding reversibility, as will be understood more fully from the discussion below.

In preferred embodiments, the padding material for both portions is compressible urethane foam. It is often especially desirable to have different density or compressibility characteristics for padding 22 and padding 42 in order to optimize the comfort and support levels in each portion of the bedding arrangement for a particular application. For example, 18045 urethane foam could be used for padding material 22 with 18028 urethane foam used for padding material 42. Alternatively, densified polyester batting, silicone foam, neoprene foam, cotton batting or the like or combinations of those materials, or even a combination of foam with a polyester core could be used as the padding materials in the present invention, according to the desired results in a given application.

The dimensions of bedding arrangement 10 can also be as desired in a given application, although in preferred embodiments the overall length and width is recommended to be 75 inches and 25 inches, respectively, with the thickness of mattress portion 20 being 3 inches and the thickness of each pillow portion 40 being 2 inches. Similarly, recommended pillow dimensions are 12.25 inches long by 25 inches wide. It will be understood that the proportions of these features in the drawings are only very roughly drawn to this scale as the exact dimensions are not critical to the applicability and function of the present invention.

Covering 60 surrounds mattress portion 20 and pillow portions 40 simultaneously and integrates them into a single unit that is inseparable under normal use. Covering 60 is preferably formed from a sheet plastic material such as Dartex P338 Cromarty polyurethane material, commercially sold by Penn Nyla of Nottingham, England. In other applications, urethane based materials, such as nylon 6 warp knitted fabric with a polyurethane transfer coating, or vinyl based or vinyl coated materials, or PVC or polyolefin laminated or coated fabrics or other heat sealable covering materials with antibacterial, antifungal and fluid penetration resistant characteristics can be employed. The seams of covering 60 are preferably heat sealed in a convention manner by radio frequency, thermal or sonic welding or sealed by chemical, adhesive or cement bonding, according to the specific materials used for covering 60 in a given application.

In order to allow internal ventilation between the interior of bedding arrangement 10 and the exterior environment, a vent arrangement 80 is provided at one end of mattress portion 20, preferably adjacent pillow portions 40. In especially preferred embodiments, that vent arrangement includes a plurality of stacked discs which permit air to readily flow into and out of covering 60, but restrict the flow of fluids, such as water and oil, articles, debris and insects into the interior of the bedding arrangement. The materials used for these discs are also preferably puncture resistant when used in stacked relation.

One such suitable vent arrangement would include an exteriorly exposed vinyl or urethane coated polyester screen disc 82, backed by a hydrophobic/oleophobic miro porous membrane disc 84, backed by an interiorly exposed vinyl or urethane coated polyester screen disc 86, backed by a polyurethane adhesive washer 88. More specifically, Textilene material commercially sold by Unitex of Central Falls, R.I. has been found suitable for discs 82 and 86 in preferred embodiments. Versipor membrane material commercially sold by Pall Specialty Materials of Port Washington, N.Y. has been found suitable for disc 84 in preferred embodiments. Polyurethane film washers commercially sold by Bemis Asso., Inc. of Shirly, Mass. have been found suitable for washer 88 in preferred embodiments. Other materials having, alone or in combination, a breathable barrier while blocking undesirable intrusions can be used in specific applications.

In preferred embodiments, the stack of discs in vent arrangement 80 is aligned with and closes an opening 62 in cover 60. For example, when opening 62 is formed to be 1 inch in diameter, the stack of discs is preferably formed to be 1.25 inch in diameter and heat sealed about the outermost 0.25 inch of its diameter against the portion of cover 60 adjacent opening 62. Thus, vent arrangement 80 would be securely positioned onto cover 60 and permit ventilation only through the discs and not about the disc peripheries.

In function, disc 82, being directly exposed to the exterior environment, includes screen openings large enough to allow air to pass freely therethrough, but forms a primary barrier to resist larger insects, articles, debris and puncture. Disc 82 also serves to positively locate and at least partially shield disc 84 from damage. Disc 84 is, for example, micro porous to allow air to flow through it in either direction, but resists the flow of fluids, such as water, blood, oil and the like, at least in a direction toward the interior of cover 60. Disc 84 also serves to resist the entry of smaller insects which might pass through disc 82. Interiorly positioned disc 86 includes screen openings large enough to allow air to pass freely therethrough, but forms a primary barrier to resist abrasive damage to disc 84 from contact with the interior materials of the bedding arrangement. Further, in stacked relation with disc 82, this interior disc also provides resistance to puncture damage from the exterior environment.

As will now be readily understood, the present invention provides numerous advantages over the prior art. Using the example of a correctional institution application, bedding arrangement 10 of the present invention is a comfortable, fully supportive, one piece unit with no separable pillow to be misused, no seams to unravel, and no thread to remove. Incisions to the interior are resisted, but readily detectable if they do occur, such that hidden contraband can be more easily located. By appropriate selection of fluid resistant material for cover 60, the entire exterior of the bedding arrangement can be easily cleaned and disinfected and the interior padding material only minimally exposed to contamination and deterioration. Mounting two pillow portions 40 on opposite sides of mattress portion 20 allows the useful life of the overall unit to be extended merely by reversing the unit, flipping the bedding arrangement over to use the other side.

The present invention thus provides a longer unit life cycle with reduced cycle costs once procured. Additionally, since only a single element is needed with pillow/mattress integration, the procurement costs themselves are reduced. Further, the slim, one piece structure of the present invention minimizes handling costs and inventory space needed for storage and replacement units.

In alternative embodiments customized for particular applications, covering 60 can be formed from materials that resist fire and/or abrasion as well. Covering 60 can also be formed from stretchable and/or shape conforming material and secure the padding materials in place by envelope, gusseted or zipper style construction.

Although certain preferred embodiments of the present invention have been described above in detail, that is only by way of illustration and example. Those of ordinary skill in the art will now appreciate that modifications and adaptations of this invention can be made to many environments of use and that the examples given are frames of reference only and not application specific requirements. Accordingly, the spirit and scope of the present invention are to be limited only by the terms of the claims below.

What we claim is:

1. A bedding arrangement comprising:

a first padding member formed and sized into a body supporting mattress portion, a second padding member formed and sized into a head supporting pillow portion, a covering member for receiving both the mattress portion and the pillow portion therein and integrating them into a single, inseparable unit during normal use, the covering member being formed from sheet plastic material whose seams are heat sealed with the first and second padding members inserted therein, the first and second padding members being each formed from compressible materials, but the compressibility of the material used in the first padding member being different from the compressibility of the material used in the second padding member, the first and second padding members also being each formed from foamed materials, but the density of the foam material used in the first padding member being different from the density of the foam material used in the second padding member, a third padding member formed and sized into another head supporting portion, the head supporting portions being each disposed at fixed locations with respect to the mattress portion, and the covering member also receiving the third padding member therein, and the head supporting portions being disposed to sandwich the mattress portion therebetween at one end of the mattress portion such that the integrated unit forms a reversible bedding arrangement.

2. The bedding arrangement according to claim 1 further including a vent arrangement therein for permitting the flow of air into and out of the covering member, but resisting the flow of fluid, such as water or oil into the covering member.

3. The bedding arrangement according to claim 2 wherein the vent arrangement includes an opening in the covering member and a screen assembly disposed to cover that opening, the screen assembly including at least one article resistant screen element and a fluid resistant membrane element.

4. The bedding arrangement according to claim 3 wherein the screen assembly includes a first screen element exposed at least in part to the exterior of the covering member and formed to be puncture resistant, a membrane member mounted interiorly of the covering member with respect to the first screen element, a second screen element mounted interiorly of the covering member with respect to the membrane member, and a washer element mounted interiorly of the covering with respect to the second screen member, all of those elements being heat sealed in place onto the covering member.

5. A vent arrangement for bedding and the like, comprising a plurality of disc elements mounted in stacked assembly over an opening through which air is permitted to pass to and from the bedding interior, including, in particular, first screen disc formed to permit the passage of air therethrough but restrict passage of debris, insects, or the like therethrough, a membrane disc mounted interiorly of the first screen disc and formed to permit passage of air therethrough but restrict the passage of water, oil or the like therethrough, and a second screen disc mounted interiorly of the membrane element and formed to permit the passage of air therethrough but to restrict contact of the bedding interior materials with the membrane disc, further including a washer disc mounted interiorly of the second screen disc and formed to enable the stacked assembly of disc to be heat sealed about the disc edges against fluid, article or air penetration.

6. A bedding assembly having an air-tight covering with sealed seams, containing therein padding material, and a vent mounted in the covering such that all airflow into and out of the covering is required to pass through the vent, that vent comprising a plurality of disc elements mounted in stacked assembly over an opening through which air is permitted to pass to and from the bedding interior, including, in particular, first screen disc formed to permit the passage of air therethrough but restrict passage of debris, insects, or the like therethrough, a membrane disc mounted interiorly of the first screen disc and formed to permit passage of air therethrough but restrict the passage of water, oil or the like-therethrough, and a second screen disc mounted interiorly of the membrane element and formed to permit the passage of air therethrough but to restrict contact of the bedding interior materials with the membrane disc.

* * * * *